US006657149B1

(12) United States Patent
Fieberg et al.

(10) Patent No.: US 6,657,149 B1
(45) Date of Patent: Dec. 2, 2003

(54) VACUUM INTERRUPTER WITH A VAPOR SHIELD

(75) Inventors: Klemens Fieberg, Berlin (DE); Klaus Gessner, Berlin (DE); Klaus Oberndoerfer, Berlin (DE); Roman Renz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/009,602

(22) PCT Filed: Jun. 9, 2000

(86) PCT No.: PCT/DE00/01919

§ 371 (c)(1),
(2), (4) Date: Apr. 8, 2002

(87) PCT Pub. No.: WO00/77807

PCT Pub. Date: Dec. 21, 2000

(30) Foreign Application Priority Data

Jun. 11, 1999 (DE) ..... 299 10 718 U

(51) Int. Cl.[7] ..... H01H 33/66
(52) U.S. Cl. ..... 218/136; 218/132
(58) Field of Search ..... 218/136–7, 118, 218/120, 134, 139, 155

(56) References Cited

U.S. PATENT DOCUMENTS

| | | | | |
|---|---|---|---|---|
| 3,048,681 A | * | 8/1962 | Polinko, Jr. | 218/137 |
| 3,586,801 A | | 6/1971 | Saito et al. | |
| RE31,797 E | * | 1/1985 | Sakuma et al. | 218/136 |
| 4,896,008 A | | 1/1990 | Aoki et al. | |
| 5,077,883 A | | 1/1992 | Schellekens et al. | |

FOREIGN PATENT DOCUMENTS

| | | |
|---|---|---|
| DE | 44 29 379 A1 | 4/1995 |
| DE | 195 10 850 C1 | 7/1996 |
| EP | 0 309 978 A2 | 4/1989 |
| EP | 0 406 944 A1 | 1/1991 |
| EP | 0 406 944 B1 | 1/1991 |
| EP | 0 406 955 A1 | 1/1991 |
| JP | 59-826 | 1/1984 |
| JP | 60-205929 | 10/1985 |
| JP | 6-196049 | 7/1994 |

* cited by examiner

*Primary Examiner*—Lincoln Donovan
(74) *Attorney, Agent, or Firm*—Morrison & Foerster LLP

(57) ABSTRACT

A vacuum interrupter with a tubular insulator, to dielectrically optimize the fixing of a vapor shield which is provided at an encircling step of the ceramic insulator. A holding ring is assigned to the vapor shield and has a cylindrical region, which is supported on the step, and an inwardly projecting collar, one end of the vapor shield being flanged onto the collar.

2 Claims, 1 Drawing Sheet

VACUUM INTERRUPTER WITH A VAPOR SHIELD

CLAIM FOR PRIORITY

This application claims priority to International Application No. PCT/DE00/01919 which was published in the German language on Jun. 9, 2000.

1. Technical Field of the Invention

The invention relates to the field of electrical components, and in particular, to components used in the design of vacuum interrupters, the housing of which has a tubular ceramic insulator and two end plates and in which the ceramic insulator is provided with an internally encircling step for securing a cylindrical vapor shield.

2. Background of the Invention

In order to protect ceramic insulators from deposits of electrode material which is vaporized during switching operations, it is customary to arrange the vapor shield at a floating potential. Typically, the insulated arrangement of the vapor shield is provided with the ceramic insulator with an internally encircling step, on one side of which the vapor shield bears by means of a conically tapering section, which merges into a cylindrical region. On the other side, there is a holding ring, which concentrically surrounds the cylindrical region of the vapor shield and is connected thereto in a positively-locking manner and with a material-to-material bond. This holding ring may have a cylindrical region and an axially adjoining, annularly bulging region, the cylindrical region being connected to the cylindrical region of the vapor shield and the annularly bulging region bearing against the step of the insulator (EP 0 309 978 A2, FIG. 5; U.S. Pat. No. 4,896,008).

It is also known to fix the vapor shield to an internally encircling step without a specific holding ring, as a result of the free end of the tapered region of the vapor shield being flanged on the other side of the step (EP 0 406 955 B1/U.S. Pat. No. 5,077,883 A).

Additionally, it is known to secure a continuously cylindrical shield to the step with the aid of a holding ring, the holding ring having an annular section, which is soldered or welded to the vapor shield, and holding parts which protrude radially on both sides of the step (U.S. Pat. No. 3,586,801 A).

To secure a vapor shield at a floating potential in vacuum interrupters whose housing has at least two hollow cylindrical ceramic insulators, it is also known to provide a metallic annular disk, which is arranged between the ceramic insulators, with a shoulder extending in the axial direction of the vacuum interrupter, in order to hold the vapor shield. This shoulder may be designed as a conically tapered piece of tube and may be provided by means of a layer of silver applied by electrodeposition, in order, when soldering the two ceramic insulators to the annular disk, at the same time to connect the vapor shield with a material-to-material bond to the vapor shield (DE 44 29 379 A1).

SUMMARY OF THE INVENTION

In one embodiment of the invention, there is a vacuum interrupter. The interrupter includes, for example, a housing which has a tubular ceramic insulator and two end plates, and in which the ceramic insulator is provided with an internally encircling step for securing a cylindrical vapor shield, the vapor shield bearing on one side of the step by means of a conically tapered section, which ends in a cylindrical region, and being fixed to the step by means of a holding ring which bears against the other side of the step, concentrically surrounds the vapor shield and is connected to the vapor shield in a positively-locking manner and with a material-to-material bond, wherein the holding ring has a cylindrical region, which is supported on the step of the ceramic insulator, and a collar which adjoins the cylindrical region, projects inward and is in the form of an arc of a circle, and the end of the cylindrical end region of the vapor shield is flanged onto the collar of the holding ring, without projecting axially beyond the holding ring.

In another aspect of the invention, the vapor shield and the holding ring consist of copper and are soldered by means of a copper/silver eutectic which has formed from an approximately 20 to 50 $\mu$m thick silver coating on the holding ring.

DETAILED DESCRIPTION OF THE PREFERRED EMBODIMENT

The invention relates to dielectrically optimizing screen holding while making it easy to produce. This is accomplished in part by considering knowledge about screen holders, which have relatively sharp edges on the side facing the ceramic insulator, that they may have an adverse effect on the dielectric properties during the vacuum interrupter tests carried out by means of high voltage.

According to one embodiment of the invention, the holding ring has a cylindrical region, which is supported on the internally encircling step of the ceramic insulator, and a collar which adjoins the cylindrical region, projects inward and is in the form of an arc of a circle, and in that the end of the cylindrical end region of the vapor shield is flanged onto the collar of the holding ring, without projecting axially beyond the holding ring.

A screen holder designed in this way is considerably easier to assemble, since after the holding ring and the vapor shield have been introduced into the insulator, all that remains in order to fix the vapor shield is a mechanical measure, namely slight flanging of one edge of the vapor shield. Any material-to-material bonding which may be provided in addition by soldering can be carried out as part of the soldering of the vacuum interrupter as a whole. In order not to have to use a solder foil, which is difficult to handle in terms of installation, it is preferable for the vapor shield and holding ring to be copper parts and for them to be soldered by means of a copper/silver eutectic which is formed during the closing soldering of the vacuum interrupter by means of an approximately 20 to 50 $\mu$m thick silver coating on the holding ring. The new shape of vapor shield and holding ring also ensures that both the holding ring and the vapor shield do not have any sharp edges which act in the direction of the ceramic insulator, i.e. there are no dielectric weak points in this region.

Figure 1:
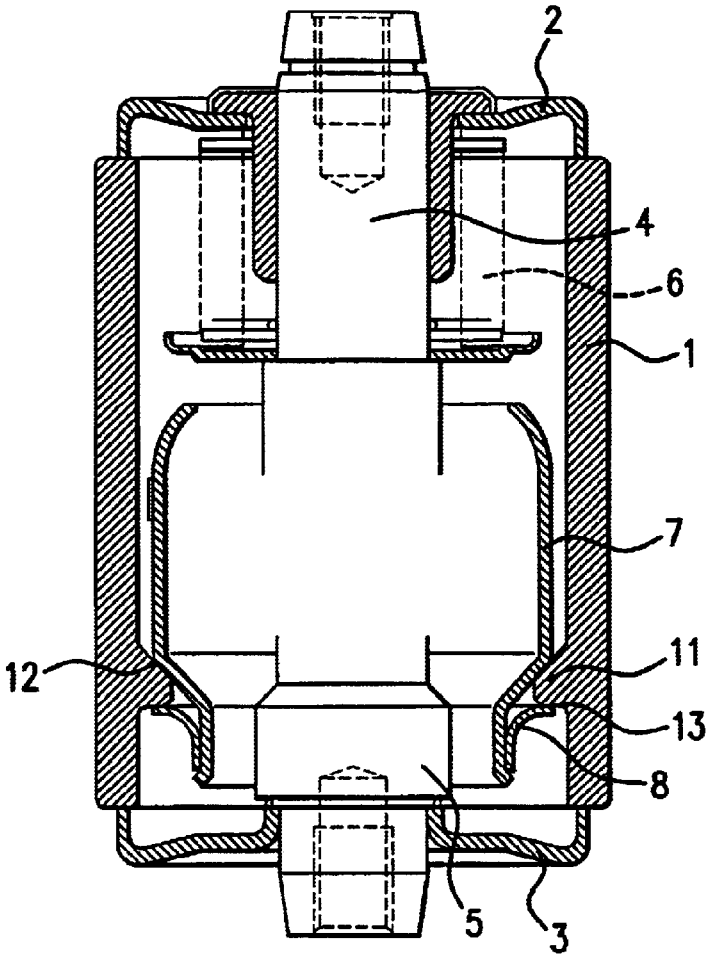
FIG. 1 PRIOR ART
FIG. 1 shows a vacuum interrupter with a conventional holder.

The housing of the known vacuum interrupter shown in FIG. 1 substantially comprises the tubular ceramic insulator 1, two end caps 2 and 3 which are soldered to this ceramic insulator, two current supply bolts 4 and 5 leading to contacts (not shown in more detail), and a bellows 6, the end cap 3 being directly soldered to the current supply bolt 5 and the end cap 2 being indirectly soldered, via the bellows 6, to the current supply bolt 4. The ceramic insulator 1 has an annularly encircling step 11, to which a vapor shield 7 is attached by means of a holding ring 8. The vapor shield and holding ring usually consist of sheet steel.

The encircling step 11 is provided on one side with a bevel 12, against which the vapor shield bears by means of a correspondingly conically tapered section. On the other side, the step 11 has a bearing surface 13 which runs transversely with respect to the ceramic insulator 1 and against which the holder 8 bears by means of a region which is curved in the form of an arc of a circle. A hollow cylindrical region of the holding ring 8 runs parallel to a corresponding section of the vapor shield 7, the end of the vapor shield 7 projecting axially beyond the holding ring 8 and being flanged outward slightly. Vapor shield and holder are usually also connected to one another by spot welding.

Figure 2:
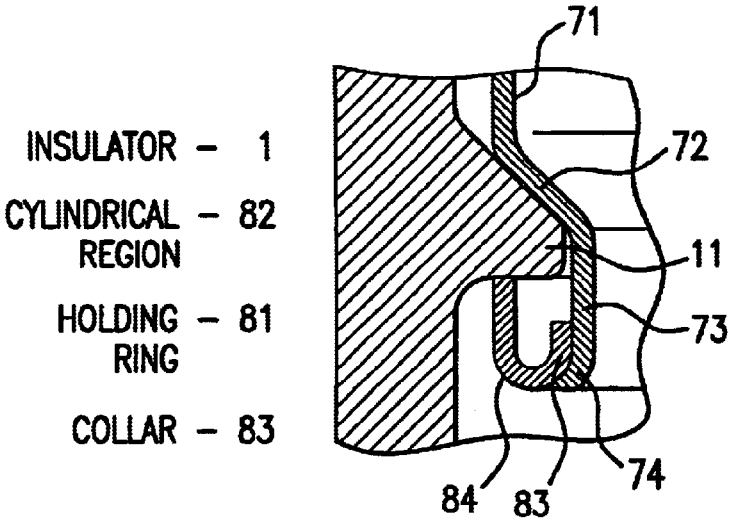
FIG. 2 is an exemplary embodiment of a holding of the vapor shield of a vacuum interrupter of the invention.

The holder shown in FIG. 2 for the vapor shield 71, which is provided on the step 11 of the ceramic insulator 1, uses a holding ring 81, which has a cylindrical region 82, which is supported against the step 11, and a collar 83 which adjoins the cylindrical region, projects inward and is in the form of an arc of a circle. A short section 74 of one end 73, which is of cylindrical design, of the vapor shield is flanged over so as to bear against this collar, the end 73 not projecting axially beyond the holding ring 81 and therefore lying in the dielectric shadow of the holding ring 81 with regard to the ceramic insulator 1. It should be noted that the conical region 72 of the vapor shield 71 only runs sufficiently far for the cylindrical region 73 to be guided along the inner edge of the step 11 with a slight clearance.

To solder the holding ring 81 to the vapor shield 7, the holding ring is provided, at least on its outer side, with a silver coating 84 which is applied by electrodeposition, melts during the closing soldering of the vacuum interrupter and forms a copper/silver eutectic with the corresponding surface layer of the holding ring 81, which consists of copper, this eutectic penetrating into the corresponding join region by means of capillary forces in order for the holding ring 81 to be soldered to the vapor shield 7.

What is claimed is:

1. A vacuum interrupter, comprising:

a housing which has a tubular ceramic insulator and two end plates, and in which the ceramic insulator is provided with an internally encircling step for securing a cylindrical vapor shield, the vapor shield bearing on one side of the step by means of a conically tapered section, which ends in a cylindrical region, and being fixed to the step by means of a holding ring which bears against the other side of the step, concentrically surrounds the vapor shield and is connected to the vapor shield in a positively-locking manner and with a material-to-material bond, wherein the holding ring has a cylindrical region, which is supported on the step of the ceramic insulator, and a collar which adjoins the cylindrical region, projects inward and is in the form of an arc of a circle, and an end of the cylindrical end region of the vapor shield is flanged onto the collar of the holding ring, without projecting axially beyond the holding ring.

2. The vacuum interrupter as claimed in claim 1, wherein the vapor shield and the holding ring of copper and are soldered by means of a copper/silver eutectic which has formed an approximately 20 to 50 $\mu$m thick silver coating on the holding ring.

* * * * *